US005893805A

United States Patent [19]

Douglass

[11] Patent Number: 5,893,805

[45] Date of Patent: Apr. 13, 1999

[54] GOLF SWING TRAINING APPARATUS

[75] Inventor: Blair C. Douglass, Phoenix, Ariz.

[73] Assignee: Vision Golf Products, L.L.C., Phoenix, Ariz.

[21] Appl. No.: 08/853,113

[22] Filed: May 8, 1997

[51] Int. Cl.[6] ..... A63B 69/36

[52] U.S. Cl. ..... 473/218; 473/270; 473/272; 473/261; 473/265

[58] Field of Search ..... 473/218, 272, 473/270, 271, 273, 261, 263, 264, 265

[56] References Cited

U.S. PATENT DOCUMENTS

| | | | |
|---|---|---|---|
| Re. 32,397 | 4/1987 | Self et al. | 273/186 A |
| 1,208,995 | 12/1916 | Lyon | 273/187 |
| 2,457,351 | 12/1948 | Crowley | 473/272 |
| 2,652,251 | 9/1953 | Molinar | 473/218 |
| 2,790,642 | 4/1957 | Rolfe | 473/272 |
| 3,350,101 | 10/1967 | Bishop et al. | 273/186 |
| 3,542,369 | 11/1970 | Anderson | 273/186 |
| 3,550,946 | 12/1970 | Menendez | 273/186 |
| 3,561,764 | 2/1971 | Thomas | 273/183 |
| 3,580,584 | 5/1971 | Trosko | 273/186 |
| 3,868,109 | 2/1975 | Fowler | 473/218 |
| 3,920,248 | 11/1975 | Medders | 273/186 C |
| 4,164,352 | 8/1979 | O'Brien | 273/187 |
| 4,384,718 | 5/1983 | Cachola | 273/187 |
| 4,526,373 | 7/1985 | Medlock | 273/186 R |
| 4,544,161 | 10/1985 | Guendling, Jr. | 273/187 A |
| 4,718,674 | 1/1988 | Henry | 273/186 C |
| 4,736,952 | 4/1988 | Taft et al. | 273/183 E |
| 4,779,872 | 10/1988 | Bisbee | 273/186 C |
| 4,784,393 | 11/1988 | Williams et al. | 273/187 R |
| 4,786,057 | 11/1988 | Brown | 273/186 R |
| 4,852,881 | 8/1989 | Bellagamba et al. | 273/183 B |
| 4,871,175 | 10/1989 | Levin et al. | 273/187 R |
| 4,913,440 | 4/1990 | Ellington | 273/186 R |
| 4,915,387 | 4/1990 | Baxstrom | 273/187 A |
| 4,930,786 | 6/1990 | Bencrisutto | 273/186 C |
| 5,035,433 | 7/1991 | Durso | 273/187 A |
| 5,108,106 | 4/1992 | Cook | 273/187 R |
| 5,110,133 | 5/1992 | Durso | 273/187 R |
| 5,139,263 | 8/1992 | Feo | 273/186.1 |
| 5,171,017 | 12/1992 | Betancourt | 273/187 R |
| 5,221,089 | 6/1993 | Barrett | 273/187.2 |
| 5,255,921 | 10/1993 | Spence | 273/187 A |
| 5,275,570 | 1/1994 | Hicks | 434/252 |
| 5,294,125 | 3/1994 | Mietz | 273/187 R |
| 5,306,011 | 4/1994 | Perry | 273/187 A |
| 5,338,037 | 8/1994 | Toyohara | 273/187.6 |
| 5,350,177 | 9/1994 | Furbush, Jr. | 273/191 R |
| 5,375,883 | 12/1994 | Marier, Jr. | 273/186.1 |
| 5,398,937 | 3/1995 | Regan | 273/186.1 |
| 5,415,407 | 5/1995 | Beatty | 273/187 R |
| 5,423,548 | 6/1995 | Bricker | 273/191 A |
| 5,433,445 | 7/1995 | Melancon | 273/186.1 |
| 5,478,081 | 12/1995 | Terry | 273/187 A |
| 5,492,330 | 2/1996 | Eldridge, Jr. et al. | 273/187.1 |
| 5,527,037 | 6/1996 | Matsumoto | 473/218 |
| 5,529,305 | 6/1996 | Wu | 473/272 |
| 5,577,967 | 11/1996 | Durso | 473/279 |
| 5,582,551 | 12/1996 | Bursi | 473/212 |
| 5,595,545 | 1/1997 | O'Brien | 473/259 |

FOREIGN PATENT DOCUMENTS

| | | |
|---|---|---|
| B-2475 | 9/1988 | Australia . |
| 16930 | 11/1911 | Canada . |
| 591840 | 8/1947 | United Kingdom . |

*Primary Examiner*—George J. Marlo
*Attorney, Agent, or Firm*—Lloyd W. Sadler

[57] ABSTRACT

A golf swing training device is described which provides visual and audible indicators to guide the golfer's visual focus thereby enhancing hand-eye coordination and providing audible feedback as the accuracy of the golf swing. This invention solves the outside-in and inside-out golf swing training problem with device and method which lightweight, easy to set up, adjustable, durable, that is capable of withstanding a direct club hit and requires no attachment to the golfer. This invention operates on the principle of training the golfer's eyes to focus on the intended swing path rather than merely providing a golf stance trainer.

18 Claims, 2 Drawing Sheets

GOLF SWING TRAINING APPARATUS

BACKGROUND OF THE INVENTION

1. Field of the Invention

This invention relates to the techniques and devices for teaching or training correct swing techniques to golfers. More specifically, this invention provides an apparatus which can be used to train golfers to employ correct eye-body coordination to recognize and improve their golf swings, permitting the trained golfers to learn to consistently hit the ball with greater accuracy by correcting the common outside-in swing path problem. Furthermore, this invention provides an apparatus which is easily carried and used by the golfer and which is adaptable to a wide variety of clubs, the needs of nearly all golfers, and both right and left-handed golfers. Moreover, this invention provides both visual guidance and audible feedback to the golfer user.

2. Description of Related Art

Golf skill training devices and the problems they purport to address are well known in the art. It is common to use various devices to teach golfers how to improve their golf skills. For many years golf professionals have experimented with many techniques and drills to help golfers solve the specific problem of an outside-in swing path. Generally, these techniques involve some combination of instruction, "mechanical thoughts," and mechanical corrections to swing. These approaches have limited, generally temporary success.

A large body of related art patents have been issued to devices for the improvement of golf swings. However, the applicant is unaware of any device or system that encompasses the combination of useful features that are embodied in this invention. In general, related art patents fall into three general classifications, as follows: (1) A group of devices which may be generally described as having a generally upwardly extending structure, employing rather complicated and inflexible guide surfaces, but which do not disclose the combination of flat strips and visual indicators of the present invention. (2) A group of mats or generally flat mechanical devices which typically do not provide the flexibility and the eye-body training of the present invention. (3) A group of devices, some of which employ flat strips or are foldable, but which fail to include the line of sight training that is the heart of the present invention.

For general background the reader is directed to U.S. Pat. Nos. 1,208,995, 3,350,101, 3,542,369, 3,550,946, 3,561,764, 3,580,584, 3,920,248, 4,164,352, 4,384,718, 4,526,373, 4,544,161, 4,718,674, 4,736,952, 4,779,872, 4,784,393, 4,786,057, 4,852,881, 4,871,175, 4,913,440, 4,915,387, 4,930,786, 5,035,433, 5,110,133, 5,139,263, 5,171,017, 5,221,089, 5,255,921, 5,275,570, 5,294,125, 5,306,011, 5,338,037, 5,350,177, 5,375,833, 5,398,937, 5,415,407, 5,423,548, 5,433,445, 5,478,081, 5,492,330, 5,527,037, 5,529,305, 5,577,967, 5,582,551, 5,595,545, Re. 32,397, and United Kingdom Patent Nos. 16,930 and 5,91,840 and Australian Patent No. AU-B-24759/88, each of which is hereby incorporated by reference in its entirety for the material disclosed therein.

The advantages of this invention over the existing devices include that it is designed specifically (1) to focus the golfer's eyes away from the ball to a position inside and in back of the target line thereby focusing the golfer on the pre-impact golf head swing path, making it much more likely that the golfer will swing the club on the correct path; (2) to utilize the golfer's natural eye-hand coordination to improve the down swing; (3) to provide a moveable sighting device and a movable audible feedback device which when used in combination give the golfer guidance for the club head path and nearly instantaneous feedback as to whether the desired path was followed; and (4) to provide a golfer training device that is adjustable, to meet the requirements of nearly all golfers, lightweight, so that it can be easily carried and set up, sized to fit in a standard golf bag and made of long lasting durable material.

SUMMARY OF THE INVENTION

It is desirable to provide a device for training golfers that corrects swing path problems that plague most golfers and to do so in a manner that coordinates eye-body motions, focusing the golfer's eyes on points or intervals on the club head path line prior to impact, thereby leading to an improved consistent golf swing.

Accordingly, it is the primary object of this invention to provide a device to assist golfers to initiate or correct their golf swings thereby assuring an optimal contact with the golf ball.

It is a further object of this invention to provide a golf swing training device which provides a clear and precise visual impression of proper golf club head path movement in its approach to the ball, resulting in a direct hit and a "down-the-line" movement of the ball after impact.

It is a further object of this invention to provide a golf swing training device that provides both visual guidance and audible feedback to the golfer.

It is a further object of this invention to provide a means for teaching golfers to avoid outside-in and inside-out swings, so as to provide improved golf drive accuracy.

It is a further object of this invention to provide a device which diagnostically assists golfers in recognizing problems with their golf swings.

It is a further object of this invention to provide a means for defining the line-of-sight to be used in conjunction with the appropriate foot placement for each type of club.

It is a further object of this invention to provide an apparatus which will assist golfers in correcting their golf swings and which is foldable, compact, light weight, and which requires no attachment to the golfer's body, which attachment can be uncomfortable and annoying.

Additional objects, features and advantages of this invention will become apparent to persons of ordinary skill in the art upon reading the remainder of the specification and upon referring to the attached figures.

These objects are achieved by a portable, foldable, lightweight device which provides an angularly adjustable club head path line, with both visual guide points and audible indicators, a foot placement guide and a sight line. All of which, when used correctly and in combination, correctly directs the golfer's eyes on the pre-impact path rather than the ball, to teach the correct golf swing.

DETAILED DESCRIPTION OF THE INVENTION

Figures 1, 1A:
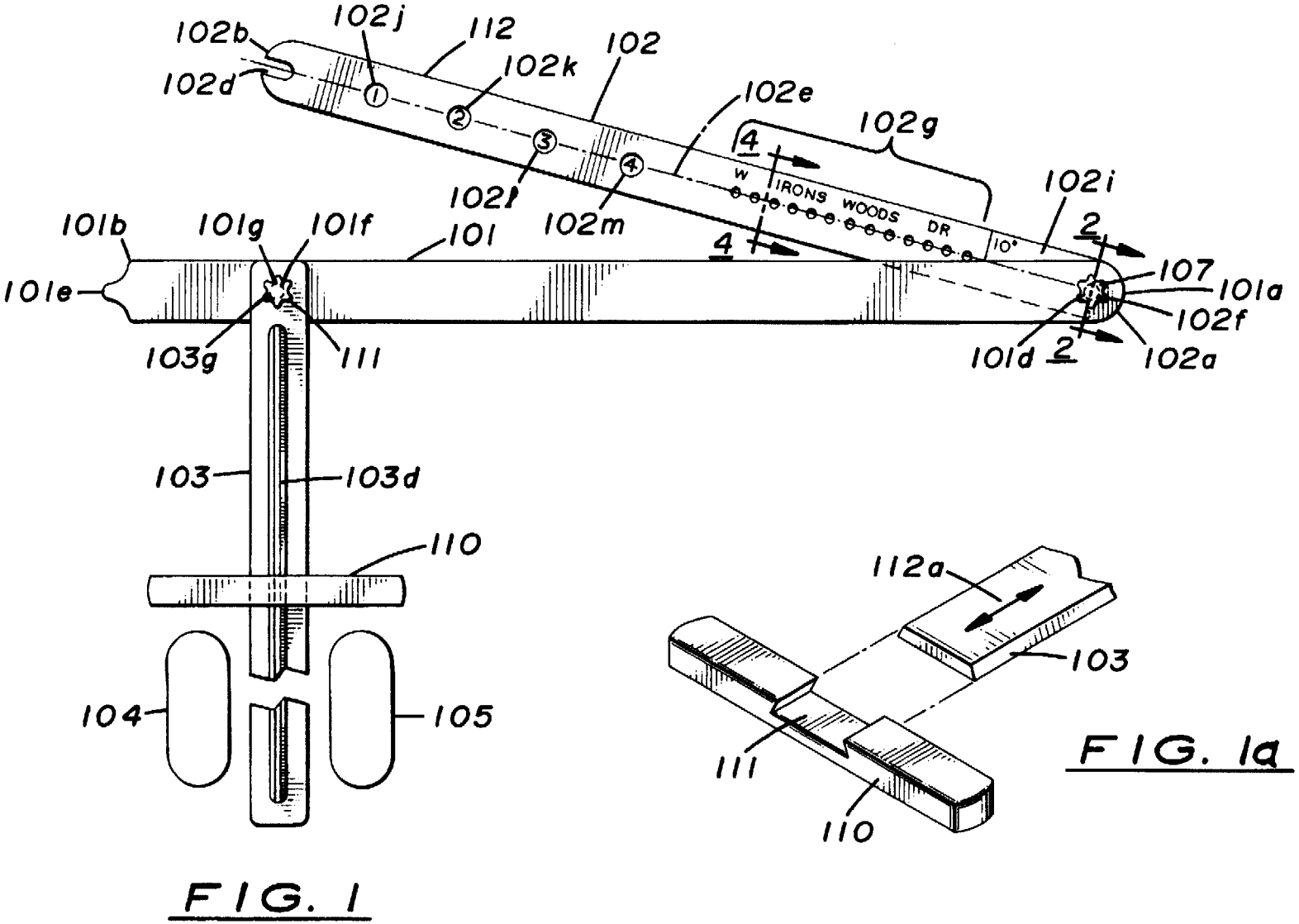
FIG. 1 is a plane view of the preferred embodiment of the invention, shown in its extended position, and indicating the position of the golfer's feet.
FIG. 1*a* is a perspective view of the preferred toe arm to foot arm connection.

The game of golf is an outdoor sport in which a player attempts to hit a small, hard ball into a hole in as few swings as possible. Players hit the ball with one of a variety of clubs. The type of club selected depends on the ball's location and distance from the hole. Golf is one of the most popular outdoor sports in the world. Millions of men, women, and children play golf as a form of recreation and exercise. Success as a golfer is largely dependent on the correctness and consistency of the golfer's swing.

Most golfers have struggled with the frustration of correcting imperfections in his or her golf swing. The "perfect" golf swing is a desirable, yet nearly an impossible goal for the average golfer to achieve without assistance. Golf instructors focus a great deal of their efforts on first identifying and then correcting imperfections in their student's golf swings. The inventor's experience has shown that eighty to ninety percent of all golfers have an outside-in swing problem. While easy to identify, the outside-in swing problem has been and continues to be one of the most difficult golf skill problems to correct.

It is, therefore, desirable to provide a training device which can help a golfer to develop a golf swing which is as perfect and consistent as possible. The results of an improved golf swing include smoothness of the stroke, accuracy of ball contact, longer and truer ball flight, an improvement in scores, all of which contribute to making great gains in the golfer's self-confidence and satisfaction.

To assist the reader in obtaining a full understanding of the invention and its benefits the following definitions of terms are provided, as used throughout the specification and claims. These terms, definitions and the following descriptions are set forth as though all golfers are right-handed. Nevertheless, these terms and this invention apply to and work equally well with left-handed golfers, except in reverse.

A "slice" results when a left-to-right, or clockwise, spin is imparted to the ball, causing it to curve to the right during flight.

A "hook" results from a right-to-left, or counterclockwise spin is imparted to the ball, causing it to curve to the left during flight.

An "outside-in" swing is one where the golf club head cuts across the ball from right to left, causing the ball to slice.

An "inside-out" swing is one where the golf club head cuts across the ball from left to right, causing the ball to hook.

The correction of "outside-in" and "inside-out" swings is the primary objective to the present invention, which when correctly employed, permits golfers to achieve golf swings that drive the ball in a desired straight and true flight path.

One of the principal causes of incorrect golf swings are the golfer's visual misperception. When standing close to the ball, as in putting, the stroke is on or close to a direct line to the target back from and through the ball. The golfer's eyes are typically directly over the ball. A full swing with an iron or wood club, however, requires that the golfer stand much further from the ball, thereby presenting a much different view of the angle and perspective of the golf stroke. Often the golf swings of beginning golfers are performed incorrectly simply because the golfer's visual perception of the swing path is too straight. With experience, golfers learn to compensate for swing problems, often developing habits of incorrect swings. After months of repetitively swinging their golf clubs incorrectly, a golfer develops "muscle memory" of an incorrect swing, making the habit very difficult to break.

Other causes, besides visual misconceptions, for not swinging the golf club correctly include the physical dominance of the right hand in right-handed golfers and of the left hand in left-handed golfers. For right-handed golfers the golf swing is primarily a left-sided movement, requiring very little help from the right side until impact, at which point, the right side takes over. This transition of control, during the golf swing, from left side to right side is difficult for most golfers and typically leads to bad swing habits.

For these reasons, if a golfer, after forming bad habits, is to eventually become proficient, it is virtually mandatory that new habits be developed. For many years golf professionals have experimented with a large number of different techniques and drills. The objective has been to help overcome and solve student's golf swing path problems. While certain techniques have helped some students, many other golfers are left with recurring incorrect golf swings. The most severe cases are the most difficult to change. These golfers' eyes and bodies have memorized the visual perception and feeling of cutting across the ball from right to left, the outside-in swing, imparting the left to right spin that causes a slice. This ingrained eye-hand coordination of the student golfer depends on angles that have been learned improperly. The golf instructor faces major problems when trying to improve the student golfer's perceptions of swing angles.

This invention approaches the golfer's swing problems by concentrating on the golfer's visual focus, by focusing the golfer's eyes "away" from the ball and on one of several specific positions or intervals on the training device. The training apparatus is used only in drill or practice, but by training the golfer to look at intervals along the swing path, the golfer's swing is reprogrammed to follow the correct swing path thereby leading to a more perfect golf swing.

FIG. 1 depicts the preferred embodiment of the apparatus of the invention as viewed from above, wherein the component parts are spread in the configuration accommodating its use for its intended purpose. Four essentially thin, flat, interconnected elongated strips are provided 101, 102, 103, 110. The target arm 101 is positioned in a central position pointed at the intended target of the ball. The purpose of the target arm 101 is to orient the apparatus toward the golfer's target, or objective for the golf ball. The target arm 101 has an attachment end 101*a*, an aim end 101*b*, and an aim point 101*e*, which is generally arrow head shaped in the preferred embodiment, at the aim end 101*b*. A guide arm 102 is provided to direct the golfer's swing path via a number of visual indicators 102*j*, 102*k*, 102*l*, 102*m*, and has a tee end 102*b* and an attachment end 102*a*, and is attached to the target arm 101 by an attachment 107 at the guide arm's 102 attachment end 102*a* and the target arm's 101 attachment end 101*a*. A foot arm 103 is rotatably attached to the target arm 101 to provide the correct positional orientation for the golfer's feet, aligned with the tee. A toe arm 110 is slidably attached to the foot arm 102, to provide a gauge the distance from golfer's toes to the tee.

Figure 3:
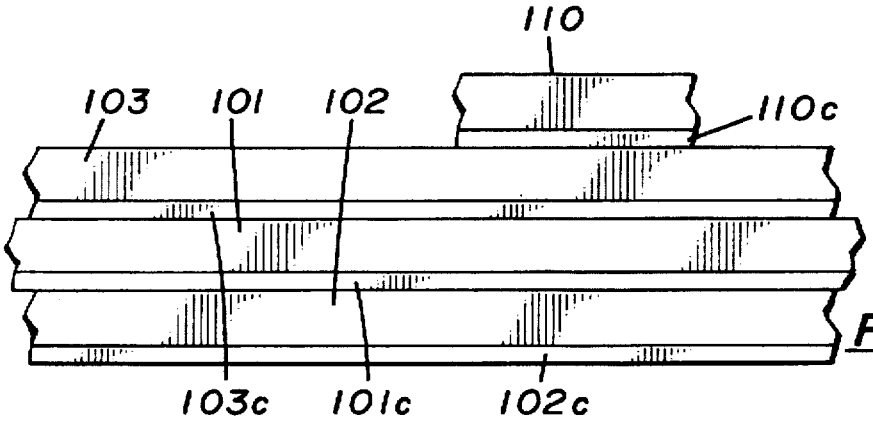
FIG. 3 is a side view of the apparatus of the invention, partially cut away to illustrate the orientation of the invention when it is folded for storage or transportation.

In the preferred embodiment of the invention, each arm, the target arm 101, the guide arm 102, the foot arm 103 and the toe arm 110, are fabricated from a tough, somewhat flexible material, such as polycarbonite, polyurethane, polypropylene or the like. Alternative materials can be selected and used without departing from the essential concept of the applicant's invention. For best operation, the selected materials should be able to absorb a great deal of abuse from rough handling as well as significant impacts from golf clubs. It is also preferred that each arm 101, 102, 103 and 110 should include, on its respective underside and securely attached thereto by a means well known in adhesion art, a layer of relatively dense and flexible foam material, illustratively shown in FIG. 3 as 101*c*, 102*c*, 103*c* and 110*c*. This foam material 101*c*, 102*c*, 103*c* and 110*c* provides shock resistance as well as adhesion to ground, floor or other supporting surface.

The target arm 101 includes a guide arm attachment hole 101*d* in the attachment end 101*a*, and a foot arm attachment hole 101*f*. The guide arm 102 similarly has a target arm attachment hole 102*f* at its attachment end 102*a*. In the preferred embodiment, foot arm attachment hole 101*f* and target arm attachment hole 102*f* are aligned and secured by a threaded insert 104, through which a screw 106, with an attached tightening knob 107, is inserted to provide a frictionally resistive pivoting attachment between the target arm 101 and the guide arm 102. Loosening the screw 106, via the tightening knob 107, will permit the arms 101 and 102 to be rotated relative to one another. A smooth washer 108 is positioned under the tightening knob 107 to ease the turning of the knob 107. It its typical operating orientation, the target arm 101 is aimed at the golf ball target and the guide arm 102 is rotated approximately ten degrees clockwise from the target arm 101. This securing structure is sometimes referred to as, and is a single preferred embodiment of, a target arm to guide arm attachment means.

Alternative embodiments of the attachment means includes a release and lock device which is selectively releasable and which has predefined lock points, one of which defines a ten degrees separation between the guide arm 102 and the target arm 101.

Figure 2:
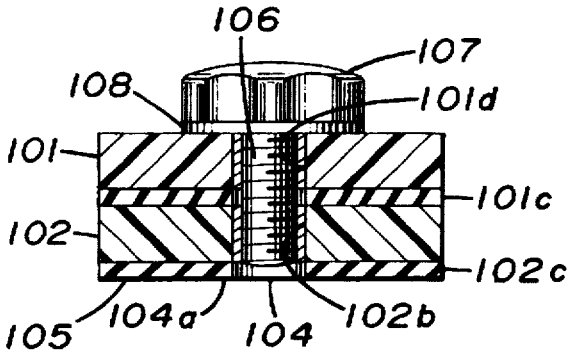
FIG. 2 is a sectional view of the folding joint of the invention, taken along line 2—2 of FIG. 1.

The target arm 101 is also attached to the foot arm 103 in a manner essentially the same as that described above as the target arm to guide arm attachment means. This securing structure is sometimes referred to as, and is a single preferred embodiment of, a target arm to guide arm attachment means. In this attachment, however, the typically operating orientation has the foot arm 103 oriented perpendicular to and counterclockwise from the target arm 101. Attachment is similarly accomplished through mating attachment holes 101*g* and 103*g* through which a screw threaded is adjusted by a tightening knob 111 identically as shown in FIG. 2 and described above.

The toe arm 110 is slidably connected to the foot arm 103. FIG. 1*a* provides additional detail as to the preferred means for slidably connecting the toe arm 110 to the foot arm 103. In the preferred connecting means, a notch 111 is provided in the center of the top surface of the toe arm 110. This notch 111 is sized to receive the foot arm 103 and to permit relative movement between the toe arm 110 and the foot arm 103 only in the foot arm's lengthwise direction, as shown in figure 1*a* by the two-headed arrow 112*a*.

Each arm 101, 102, 103 and 110, is typically, though they need not necessarily be, the same width, in the preferred embodiment 2½ inches; the same thickness, in the preferred embodiment ¼ inch. The target arm 101 is typically 48 inches in length. The guide arm 102 is typically 41½ inches in length. The foot arm 103 is typically 36 inches in length. The toe arm 110 is typically 12 inches in length. Alternative lengths, widths and thicknesses are possible and should be considered within the scope of this disclosure.

The invention also incorporates a number of visual indicators which act as guides for the user. The foot arm 103 typically includes a line or stripe 103*d* along its length, and may include a series of markings identified with letters or numbers to indicate the distance from the golfer-user's feet and the ball, positioned in the middle of the top surface of the foot arm 103. This line or stripe 103*d* is provided as a guide for the positioning of the user's feet in preparation for and during the golf swing. Representations of the user's foot positions are indicated 104 and 105.

Figure 4:
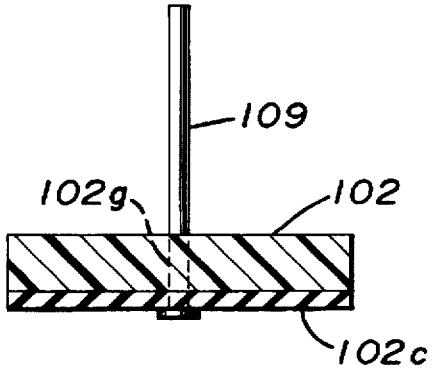
FIG. 4 is a sectional view taken along line 4—4 of FIG. 1.

The guide arm 102, which has an attachment end 102*a* attached to the attachment end of the target arm 101*a*, as described above, has at a slotted end 102*b* with a slot 102*d* designed to receive a golf tee, not shown, for supporting the golf ball prior to the club impact. Spaced along the length of the guide arm's 102 top surface are a series of indicators 102*j*, 102*k*, 102*l*, 102*m*. Typically these indicators are labeled numerically, such as "1", "2", "3", "4". These indicators 102*j*, 102*k*, 102*l*, 102*m* are spaced about 3 to 4 inches apart and may be in a line or a may be spaced at different distances from the center line of the guide arm 102. Beyond this series of indicators 102*j*, 102*k*, 102*l*, 102*m* and toward the attachment end of the guide arm 102*a* are provided a series of small holes 102*g*, usually about thirteen in number to correspond to available golf clubs. Typically these small holes 102*g* are positioned along the center line 102*e* of the top surface of the guide arm 102. During use a single thin flexible member 109 is positioned in the hole 102*g* appropriate to the club in use. FIG. 4 shows a detailed cross section diagram of the flexible member 109 as inserted for use in a hole 102*g*. The purpose of the flexible member 109 is to provide an audible "click" when contacted by a golf club, during a golf swing, when the club is along the correct swing path and at the right height for optimal contact with the ball. Adjacent to the series of small holes 102*g* are a series of inscriptions that indicate which hole 102*g* should have a flexible member 109 inserted based on the club being used. It is apparent from the positions of these inscriptions that the longer clubs (woods and drivers) should follow the swing path for a longer distance than the shorter clubs. While the flexible members 109 are typically 2 to 2½ inches in length, a variety of lengths may alternatively be employed depending on the user and the club in use.

Near the attachment end 102*a* of the guide arm 102 an indicator 102*i* is provided to show the preferred angle of 10 degrees between the guide arm 102 and the target arm 101 when the device is set up for use. In a preferred embodiment of the invention, the indicator 102*i* is a triangle printed on the top surface of the guide arm, where the hypotenuse of the triangle is aligned with an adjacent edge of the target arm 101, such that the two arms 101, 102 are spread apart to define an angle of 10 degrees. Alternative angles can also be employed in the use of the invention to best fit the device to the particular golfer-user. Indeed, the invention is specifically designed to accommodate any useful angle between the guide arm 102 and the target arm 101.

In operation, the various arms of the invention are spread apart in the position indicated in FIG. 1. A golf ball is placed on a tee intermediate in the slot 102*d* and the head of the golf club is rested adjacent to the ball, with its "sweet spot" aligned with the center of the ball. The golfer stands with his or her feet placed on either side of the foot arm 103 with his or her toes just behind the toe arm 110, equidistant from the foot strip 103 and at a comfortable distance from the target arm 101. It will be understood that when the various arms of the invention are so oriented, the series of indicators 102*j*, 102*k*, 102*l*, 102*m*, while being in a generally straight line along the center line 102*e* of the guide arm 102, and the individual holes 102*g* with a flexible member 109 installed in the appropriate designated hole of 102*g*, is incrementally closer to the target arm 101 and to the user-golfer, from left to right (for right-handed golfers). It should also be understood that the indicators 102*j*, 102*k*, 102*l*, 102*m*, when followed accurately with the user's eyes, have the strongest influence upon the swing accuracy, because the hand-eye coordination of the golfer tends to direct the swing of the golf club where the golfer's eyes are focused.

As the golfer begins his or her backward swing of the golf club, the club head is caused to move along an arc intersecting the flexible member 109 and the appropriate indicator 102*j*, 102*k* 102*l*, or 102*m*. The club is then brought downward and forward through the same arc, in the opposite direction. Again the club passes over the appropriate indicator 102*j*, 102*k*, 102*l* or 102*m*. During this phase of the swing, the golfer-user's eyes are not on the ball. Rather, they focus on the path of the swing, through the indicators 102*j*, 102*k*, 102*l* and 102*m*, resulting in a swing arc which reaches its apex in a generally flat portion of the swing immediately leading to the ball, thereby resulting in an optimal or nearly optimal straight and accurate drive of the golf ball. When used correctly, the golfer-user keeps his or her eyes on the visual indicators even after impact with the ball. This swing pattern obviates any tendency of the golfer-user to strike the ball either outside-in or inside-out, thereby fulfilling the primary objective of this invention. The golfer-user is trained to focus his or her eyes on pre-impact swing, greatly enhancing correct eye-hand coordination.

Additionally, this invention includes a guide wire 112 for to providing the golfer-user with an indication of an outside-in golf swing in need of correction. In the best mode of the invention, this guide wire 112, is installed in a slot approximately midway between the first visual indicator 102*j* and the second visual indicator 102*k*, on the side away from the golfer-user. Typically, this guide wire 112 extends approximately ½ inch from the side of the guide arm 102 and extends from 2 inches to 2½ inches vertically up from the surface of the guide arm 102. This guide wire 112 is generally "L" shaped and may be composed of any generally thin, lightweight and flexible material, including metal and plastic.

Figure 5:
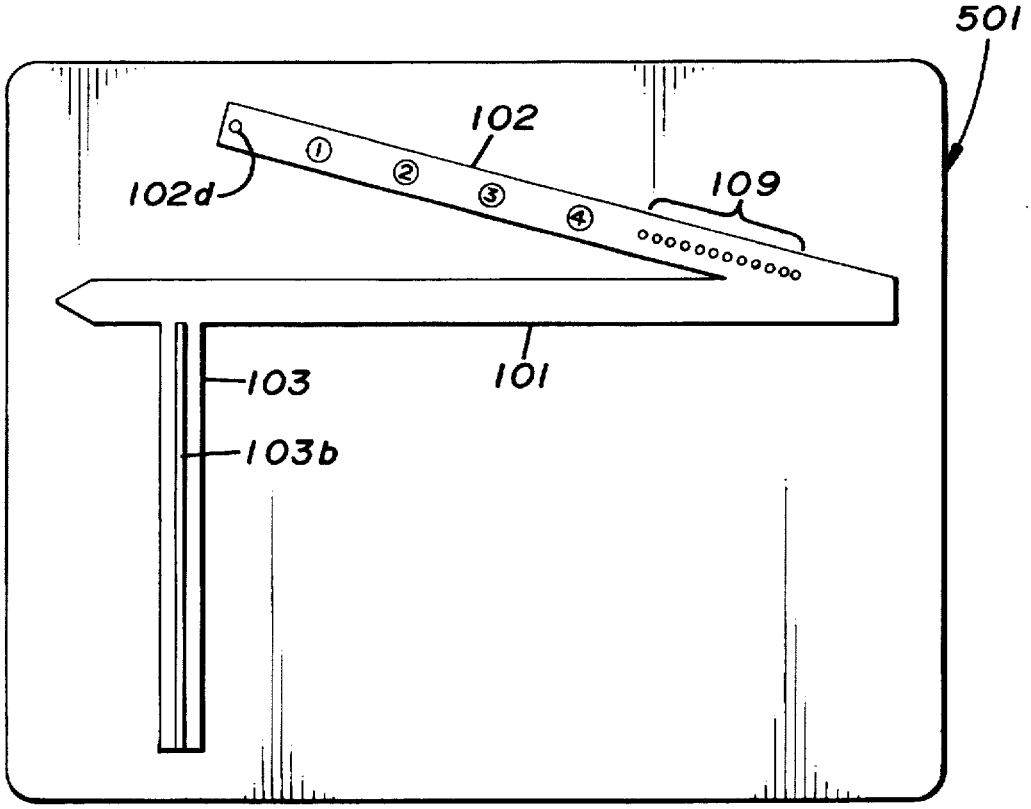
FIG. 5 is a plan view of the mat-type alternative embodiment of the invention.

An alternative embodiment of the invention is illustrated in FIG. 5. In this embodiment, the various arms of the invention are imprinted on the surface of a generally flat mat or rug 501. This form of the invention has the advantages of being capable of being rolled up or folded when not in use and requiring no other set up. However, it has the relative disadvantage of being somewhat less adjustable to meet the individual needs of the golfer-users. FIG. 5 shows a diagram similar for FIG. 1 imprinted on the mat 501. It is apparent that these imprints may be equivalently artistically varied in any number of ways so long as the relative positions of the arms are oriented as described above.

After the described invention is repetitively utilized, the muscular control, coordination and eye action of the golfer-user are "learned" and "remembered," so that the golfer incorporates the eye-hand coordination and control without the training device in his or her regular golf game while looking at the ball. Continued use, training and evaluation of the invention assists golfer-users to analyze and maintain the optimal golf swing.

I claim:

1. An apparatus for improving a golf swing comprising:

(A) a target arm for indicating he orientation of the apparatus toward a golf target location;

(B) a guide arm for providing one or more indications of the golf swing correctness;

(C) a first attachment adjustably connecting said target arm to said guide arm to permit said target arm to be rotatably adjusted relative to said guide arm; and (D) a flexible member positioned in an hole provided in said guide arm, wherein said flexible member provides an audible indication when contacted by a golf club head which is proceeding along a correct swing path.

2. An apparatus for improving a golf swing, as recited in claim 1, further comprising:

(D) a foot arm to provide a foot position guide to the user and (E) a second attachment adjustably connecting said foot arm to said target arm to permit said foot arm to be rotatably adjusted relative to said target arm.

3. An apparatus for improving a golf swing, as recited in claim 2, further comprising:

(F) a toe arm slidably connected to said foot arm to provide a guide for the user's positioning of distance from feet to said target arm.

4. An apparatus for improving a golf swing, as recited in claim 2, wherein said foot arm includes a material selected from a class of materials comprising polyurethane and polypropylene.

5. An apparatus for improving a golf swing, as recited in claim 2, wherein said foot arm includes a resilient foam layer to absorb shock and to adhere to the practice surface.

6. An apparatus for improving a golf swing, as recited in claim 1, wherein said guide arm further comprises:

(1) one or more visual indicators to designate to the user the golf swing path.

7. An apparatus for improving a golf swing, as recited in claim 1, wherein said guide arm further comprises:

(2) one or more audible indicators to designate to the user the golf swing path.

8. An apparatus for improving a golf swing, as recited in claim 1, wherein said guide arm further comprises:

(3) an angle indicator to designate the desired angle of adjustment between said guide arm and said target arm.

9. An apparatus for improving a golf swing, as recited in claim 1, wherein said guide arm further comprises:

(4) a notch for receiving a golf ball.

10. An apparatus for improving a golf swing, as recited claim 1, wherein said guide arm includes a material selected from the class of materials comprising polyurethane, polycarbonite and polypropylene.

11. An apparatus for improving a golf swing, as recited in claim 1, wherein said guide arm includes a resilient foam layer to absorb shock and to adhere to the practice surface.

12. An apparatus for improving a golf swing, as recited in claim 1, wherein said target arm further comprises a pointed end for designating the intended target of the golf ball.

13. An apparatus for improving a golf swing, as recited in claim 1, wherein said target arm includes a material selected from the class of materials comprising polyurethane and polypropylene.

14. An apparatus for improving a golf swing, as recited in claim 1, wherein said target arm includes a resilient foam layer to absorb shock and to adhere to the practice surface.

15. A mat for practicing and improving golf swings comprising:

(A) a flexible mat adapted to be spread upon a generally flat surface; and (B) a pattern imprinted upon said mat, wherein said pattern includes:

(1) a guide symbol, adapted to provide indications of swing accuracy;

(2) a target symbol, adapted to provide an aim point towards the user's desired objective for the golf ball;

(3) a foot positioning symbol, adapted to provide a guide for the positioning of the user's feet; and (4) a flexible member positioned in an hole provided in said guide symbol, wherein said flexible member provides an audible indication when contacted by a golf club head which is proceeding along a correct swing path.

16. A mat for practicing and improving golf swings, as recited in claim 15, further comprising a generally flexible and impact resistant material.

17. A mat for practicing and improving golf swings, as recited in claim 15, further comprising one or more openings for receiving a generally flexible member for providing audible indications as to whether the golf club is following the desired swing path.

18. A mat for practicing and improving golf swings, as recited in claim 15, further comprising one or more visual indicators to guide the user's eyes during a golf swing.

* * * * *